United States Patent [19]

Baillargeon et al.

[11] Patent Number: 5,039,308

[45] Date of Patent: Aug. 13, 1991

[54] MULTIFUNCTIONAL FUEL ADDITIVES

[75] Inventors: David J. Baillargeon, West Windsor Township, Middlesex County; Angeline B. Cardis, Florence; Dale B. Heck, West Deptford, all of N.J.

[73] Assignee: Mobil Oil Corporation, Fairfax, Va.

[21] Appl. No.: 449,182

[22] Filed: Dec. 13, 1989

[51] Int. Cl.[5] ..... C10L 1/18; C10L 1/22

[52] U.S. Cl. ..... 44/351; 44/391; 560/52; 560/54

[58] Field of Search ..... 44/57, 62; 560/52, 54

[56] References Cited

U.S. PATENT DOCUMENTS

| | | | |
|---|---|---|---|
| 4,075,240 | 2/1978 | Schimmel et al. | 560/54 |
| 4,194,885 | 3/1980 | Audeh | 44/63 |
| 4,281,152 | 7/1981 | Huemmer et al. | 560/52 |
| 4,430,092 | 2/1984 | Jenkins, Jr. et al. | 560/52 |
| 4,524,215 | 6/1985 | Lang et al. | 560/52 |
| 4,744,798 | 5/1988 | Andress | 44/70 |
| 4,758,247 | 7/1988 | Sung | 44/62 |

*Primary Examiner*—Olik Chaudhuri
*Assistant Examiner*—Ellen McAvoy
*Attorney, Agent, or Firm*—Alexander J. McKillop; Charles J. Speciale; Howard M. Flournoy

[57] ABSTRACT

Additives which improve the low-temperature properties of distillate fuels are the reaction products of (1) diaminodiols, and (2) the product of benzophenone tetracarboxylic dianhydride and aminoalcohols and/or amines with long-chain hydrocarbyl groups attached.

39 Claims, No Drawings

MULTIFUNCTIONAL FUEL ADDITIVES

BACKGROUND OF THE INVENTION

This application is directed to multifunctional additives which improve the low temperature properties of distillate fuels and to fuel compositions containing minor amounts thereof.

Traditionally, the low-temperature properties of distillate fuels have been improved by the addition of kerosene, sometimes in very large amounts (5–70 wt %). The kerosene dilutes the wax in the fuel, i.e. lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polymeric materials with pendant fatty hydrocarbon groups. These additives are limited in the range of their activity, however; most improve fuel properties by lowering the pour point and/or filterability temperature. These additives have little or no effect on the cloud point of the fuel.

No art is known to applicants which teaches or suggest the additive products and compositions of this invention. However, U.S. Pat. Nos. 3,910,987 and 3,910,981 disclose the use of certain aminodiols in the preparation of petroleum additives.

The additives of this invention are substantially different, however, both in terms of structure and function. They are oligomeric and/or polymeric materials obtained via condensation reactions, e.g. the reaction of diaminodiols with acids and/or anhydrides. In terms of activity, these additives effectively lower distillate fuel cloud point, thus providing improved low-temperature fuel properties, and offering a unique and useful advantage over known distillate fuel additives.

These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

SUMMARY OF THE INVENTION

This application is directed to novel diaminodiol derived oligomeric/polymeric benzophenone tetracarboxylate esters and ester/amides which have been found to be surprisingly active wax crystal modifier additives for distillate fuels. Distillate fuel compositions containing minor amounts of such additives demonstrate significantly improved low-temperature properties, with lower cloud point and lower CFPP (Cold Filter Plugging Point) filterability temperature.

These oligomeric/polymeric additives are the reaction products derived from two types of monomer components. The first monomer type is a diaminodiol, either alone or in combination with other diaminodiols, derived from the reaction of a diglycidyl ether and an amine. The second monomer type is a reactive acid/anhydride product, either alone or in combination with other such monomers, derived from the reaction of benzophenone tetracarboxylic dianhydride (BTDA) with either (a) an aminoalcohol, the product of an amine and an epoxide, or (b) a combination of an aminoalcohol (a) and an amine.

The additive compositions, described in this application are unique in structure and activity. The additive concentrates and fuel compositions containing such additives are also unique. Similarly, the processes for making these additives, additive concentrates, and fuel compositions are unique.

DESCRIPTION OF SPECIFIC EMBODIMENTS

The additives of this invention have oligomeric (i.e. dimers, trimers, etc.) and/or polymeric structures. Various hydrocarbyl groups, especially groups containing linear paraffinic substructures, are distributed along the backbone of the oligomer and/or polymer, and may be carried by either or both of the comononers used.

One of the comonomers, alone or in combination, used in the synthesis of these additives is a diaminodiol. The diaminodiols of this invention are the reaction products of a diglycidyl ether and a secondary amine. Such a diaminodiol provides the capability of introducing additional linear hydrocarbyl groups along the oligomer/polymer backbone, thus increasing the overall density of linear hydrocarbyl groups in the final additive structure. However, any diaminodiol may be used in this invention and may include, but is not limited by, examples given below.

The diaminodiols are those diols, for example, derived from the reaction of two equivalents of a secondary amine and a diglycidyl ether, according to the following general scheme:

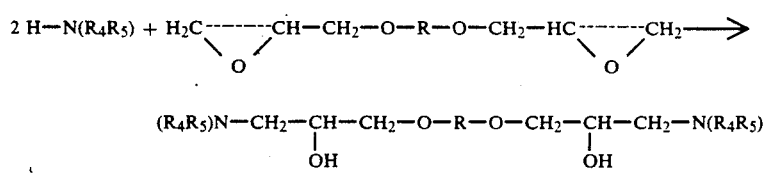

where $R = C_1$ to about $C_{100}$ hydrocarbyl, or $C_1$ to about $C_{100}$ hydrocarbyl containing nitrogen, sulfur, phosphorus, boron, silicon and/or oxygen.

$R_4 = C_8$ to about $C_{50}$ hydrocarbyl group, preferably linear, either saturated or unsaturated.

$R_5 = R_4$, $C_1$ to about $C_{100}$ hydrocarbyl, or $C_1$ to about $C_{100}$ hydrocarbyl containing nitrogen, sulfur, phosphorus and/or oxygen.

The other comonomer, alone or in combination, used in the synthesis of these additives is a reactive acid and/or anhydride derived from the reaction of benzophenone tetracarboxylic dianhydride (BTDA) or its acid equivalent, and suitable pendant groups derived from alcohols and amines with some combination of hydrocarbyl, preferably linear groups attached. These pendant groups include (a) aminoalcohols, derived from a secondary amine capped with an olefin epoxide, (b) combinations of the aminoalcohol from (a) and an amine, and (c) combinations of two or more different aminoalcohols. These pendant groups usually contain from 8 to about 100 carbon atoms or more.

The additives of this invention are the reaction products obtained by combining the two monomer types described above in differing ratios using standard esterification techniques according to the following stepwise procedure:

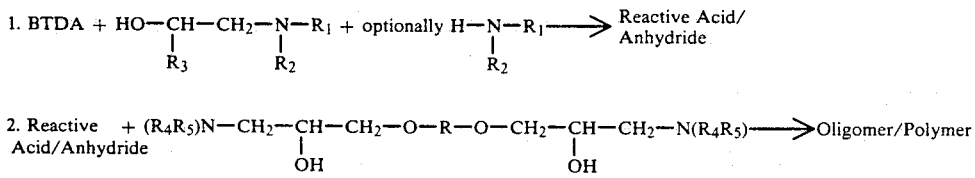

For example, a general structure for the oligomers/polymers derived from BTDA partial ester and diaminodiol is as follows:

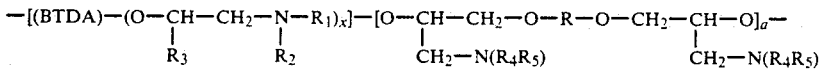

Also, oligomers/polymers analogous to these may be derived from BTDA mixed partial ester, i.e. BTDA derivatives where the pendant aminoalcohols are different from one another.

A general structure for the oligomers/polymers derived from BTDA partial ester/amide and diaminodiol is as follows:

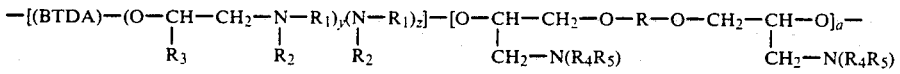

Where:

$x=y+z=0.5$ to about 3.5, preferably from about 1 to 3, $a=0.25$ to about 2, preferably from about 0.5 to 1.25, $R_1$, $R_3$, $R_4=C_8$ to about $C_{50}$ hydrocarbyl, either saturated or unsaturated, and preferably linear $R_2=R_1$, $C_1$ to about $C_{100}$ hydrocarbyl, or $C_1$ to about $C_{100}$ hydrocarbyl containing nitrogen, sulfur, phosphorus and/or oxygen, $R_5=R_4$, $C_1$ to about $C_{100}$ hydrocarbyl, or $C_1$ to about $C_{100}$ hydrocarbyl containing nitrogen, sulfur, phosphorus and/or oxygen.

In a one-pot synthesis the diaminodiol is prepared by suitably reacting an amine or mixture of amines with a diglycidyl ether, the aminodiol is prepared by reacting an amine or a mixture of amines with an epoxide or mixture thereof, and thereafter reacting these resultant products with BTDA or its acid equivalent.

A highly preferred amine is di(hydrogenated tallow) amine. Other suitable amines include but are not limited to ditallow amine, dioctadecylamine, methyl octadecyl amine, and other secondary amines.

Included within the scope of the epoxides as set forth above, are ethylene oxide, 1,2-epoxydecane, 1,2-epoxydodecane, 1,2-epoxytetradecane, 1,2-epoxypentadecane, 1,2-epoxyhexadecane, 1,2-epoxyheptadecane, 1,2-epoxyoctadecane, 1,2-epoxyeicosane and mixtures thereof. Especially preferred is 1,2-epoxyoctadecane and ethylene oxide.

Included within the scope of diglycidyl ethers are any di-epoxide reaction products derived from any diol, and two molar amounts of epichlorohydrin (or synthetic equivalents).

The reactions can be carried out under widely varying conditions. For example, temperatures may vary form about 50° to about 250° C., the pressure may be atmospheric or slightly higher or autogenous. The times for the complete reaction may vary from 1 to 24 hours up to 48 hours or more.

The temperatures chosen will depend upon the particular reactants and on the solvent, if one is used. Typically hydrocarbon solvents such as xylene or mixed xylenes can be used. However, any polar, non-reactive solvent including benzene, toluene or mixtures thereof can be used.

Molar ratios, less than molar ratios or more than molar ratios of the reactants can be used. Preferentially a molar ratio of diaminodiol to reactive BTDA intermediate of 1:1 may be used.

In general, the reaction products of the present invention may be employed in any amount effective for imparting the desired degree of activity necessary to improve the low temperature characteristics of distillate fuels. In many applications the products are effectively employed in amounts from about 0.001% to about 10% by weight and preferably from less than 0.01% to about 5% of the total weight of the composition. These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commerical methods, such as, acid or caustic treatment, hydrogenation, solvent refining, clay treatment, etc.

The distillate fuel oils are characterized by their relatively low viscosities, pour points, and the like. The principal property which characterize the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T, Typical jet fuels are defined in Military Specification MIL-F-5624B.

The following examples are illustrative only and are not intended to limit the scope of the invention.

EXAMPLES

EXAMPLE 1

Preparation of Additive 1

Di(hydrogenated tallow) amine (60.0 g, 0.12 mol; e.g. Armeen 2HT from Akzo Chemie), 2,2-dimethyl-1,3-propanediol diglycidyl ether (10.9 g, 0.050 mol; e.g. Azepoxy N form AZS Corporation), and 1,2-epoxyoctadecane (14.2 g, 0.053 mol; e.g. Vikolox 18 for Viking Chemical) were combined and heated at 140° to 150° C. for three hours, and at 165° to 170° C. for 16 to 20 hours. Benzophenone tetracarboxylic dianhydride (17.0 g, 0.053 mol; e.g. BTDA from Allco Chemical Corporation) and xylene (approximately 50 ml) were added and heated at reflux (180° to 190° C.) with azeotropic removal of water for 24 hours. Volatiles were then removed from the reaction medium at 190° C., and the reaction mixture was hot filtered through diatomaceous earth to give 90.2 g of the final product.

EXAMPLE 2

Preparation of Additive 2

According to the procedure used for Example 1, di(hydrogenated tallow) amine (60.0 g, 0.12 mol), 2,2-dimethyl-1,3-propanediol diglycidyl ether (6.29 g, 0.029 mol), and 1,2-epoxyoctadecane (24.4 g, 0.091 mol) were combined. Then, benzophenone tetracarboxylic dianhydride (12.9 g, 0.040 mol) and xylene (approximately 50 ml) were added and allowed to react. After isolation, 95.0 g of the final product was obtained.

EXAMPLE 3

Preparation of Additive 3

According to the procedure used for Example 1, di(hydrogenated tallow) amine (60.0 g, 0.12 mol), 1,4-butanediol diglycidyl ether (8.38 g, 0.029 mol; e.g. Araldite RD-2 from Ciba-Geigy Company), and 1,2-epoxyoctadecane (24.4 g, 0.091 mol) were combined. Then, benzophenone tetracarboxylic dianhydride (12.9 g, 0.040 mol) and xylene (approximately 50 ml) were added and allowed to react. After isolation, 96.8 g of the final product was obtained.

EXAMPLE 4

Preparation of Additive 4

According to the procedure used for Example 1, di(hydrogenated tallow) amine (60.0 g, 0.12 mol), a polyetherglycol diglycidyl ether with an average molar weight of 380 (11.0 g, 0.029 mol; e.g. DER 736 from Dow Chemical Company), and 1,2-epoxyoctadecane (24.4 g, 0.091 mol) were combined. Then, benzophenone tetracarboxylic dianhydride (12.9 g, 0.040 mol) and xylene (approximately 50 ml) were added and allowed to react. After isolation, 98.0 g of the final product was obtained.

EXAMPLE 5

Preparation of Additive 5

According to the procedure used for Example 1, di(hydrogenated tallow) amine (60.0 g, 0.12 mol), a polyetherglycol diglycidyl ether with an average molar weight of 630 (15.3 g, 0.024 mol; e.g. DER 732 from Dow Chemical Company), and 1,2-epoxyoctadecane (20.3 g, 0.076 mol) were combined. Then, benzophenone tetracarboxylic dianhydride (10.7 g, 0.033 mol) and xylene (approximately 50 ml) were added and allowed to react. After isolation, 88.9 g of the final product was obtained.

EXAMPLE 6

Preparation of Additive 6

According to the procedure used for Example 1, di(hydrogenated tallow) amine (60.0 g, 0.12 mol), 2,2-dimethyl-1,3-propanediol diglycidyl ether (10.2 g, 0.047 mol), and 1,2-epoxyoctadecane (14.4 g, 0.054 mol) were combined. Then, benzophenone tetracarboxylic dianhydride (7.60 g, 0.024 mol), phthalic anhydride (3.49 g, 0.024 mol; e.g. from Aldrich Chemical Company), and xylene (approximately 50 ml) were added and allowed to react. After isolation, 87.5 g of the final product was obtained.

EXAMPLE 7

Preparation of Additive 7

According to the procedure used for Example 1, di(hydrogenated tallow) amine (60.0 g, 0.12 mol), 1,4-butanediol diglycidyl ether (13.6 g, 0.047 mol), and 1,2-epoxyoctadecane (14.4 g, 0.054 mol) were combined. Then, benzophenone tetracarboxylic dianhydride (7.60 g, 0.024 mol), phthalic anhydride (3.49 g. 0.024 mol), and xylene (approximately 50 ml) were added and allowed to react. After isolation, 88.6 g of the final product was obtained.

EXAMPLE 8

Preparation of Additive 8

According to the procedure used for Example 1, di(hydrogenated tallow) amine (60.0 g, 0.12 mol), DER 736 (17.9 g, 0.047 mol), and 1,2-epoxyoctadecane (14.4 g, 0.054 mol) were combined. Then, benzophenone tetracarboxylic dianhydride (7.60 g, 0.024 mol), phthalic anhydride (3.49 g, 0.024 mol), and xylene (approximately 50 ml) were added and allowed to react. After isolation, 93.0 g of the final product was obtained.

EXAMPLE 9

Preparation of Additive 9

According to the procedure used for Example 1, di(hydrogenated tallow) amine (50.0 g, 0.10 mol), DER 732 (24.8 g, 0.039 mol), and 1,2-epoxyoctadecane (12.0 g, 0.045 mol) were combined. Then, benzophenone tetracarboxylic dianhydride (6.33 g, 0.020 mol), phthalic anhydride (2.91 g, 0.020 mol), and xylene (approximately 50 ml) were added and allowed to react. After isolation, 87.2 g of the final product was obtained.

EXAMPLE 10

Preparation of Additive 10

According to the procedure used for Example 1, di(hydrogenated tallow) amine (61.2 g, 0.12 mol), 2,2-dimethyl-1,3-propanediol diglycidyl ether (6.49 g, 0.030 mol), and 1,2-epoxyoctadecane (8.55 g, 0.030 mol) were combined. Then, benzophenone tetracarboxylic dianhydride (9.67 g, 0.030 mol) and xylene (approximately 50 ml) were added and allowed to react. After isolation, 76.4 g of the final product was obtained.

Preparation of Additive Concentrate

A concentrate solution of 100 ml total volume was prepared by dissolving 10 g of additive in mixed xylenes solvent. Any insoluble particulates in the additive concentrate were removed by filtration before use.

Test Procedures

The cloud point of the additized distillate fuel was determined using two procedures:

(a) an automatic cloud point test based on the equipment/procedure detailed in U.S. Pat. No. 4,601,303; the test designation (below) is "AUTO CP";

(b) an automatic cloud point test based on the commercially availabel Herzog cloud point tester; the test designation (below is "HERZOG".

The low-temperature filterability was determined using the Cold Filter Plugging Point (CFPP) test. This test procedure is described in *Journal of the Institute of Petroleum*, Volume 52, Number 510, June 1966, pages 173 to 185.

The characteristics of Diesel Fuel A and B were as follows:

| (Test Fuel Characteristics) | FUEL A | FUEL B |
|---|---|---|
| API Gravity | 35.5 | 34.1 |
| Cloud Point, °F. | | |
| Auto CP | 15 | 22 |
| Herzog | 16.4 | 23.4 |
| CFPP, °F. | 9 | 10 |
| Pour Point, °F. | 10 | 0 |

TABLE

Test Results
Additive Effect on the Cloud Point and Filterability (CFPP) of Distillate Fuel (Additive Concentration = 0.1% wt)
Improvement in Performance Temperature (°F.)

| | Diesel Fuel A | | | Diesel Fuel B | | |
|---|---|---|---|---|---|---|
| Additive | Auto CP | Herzog | CFPP | Auto CP | Herzog | CFPP |
| 1 | 5 | 3.4 | 4 | 11 | 5.8 | 4 |
| 2 | — | 1.8 | 6 | — | 6.7 | 9 |
| 3 | — | 1.5 | −6 | — | 6.7 | 9 |
| 4 | — | 1.8 | 4 | — | 7.6 | 6 |
| 5 | — | 2 | 6 | — | 7.6 | 6 |

TABLE-continued

Test Results
Additive Effect on the Cloud Point and Filterability (CFPP) of Distillate Fuel (Additive Concentration = 0.1% wt)
Improvement in Performance Temperature (°F.)

| | Diesel Fuel A | | | Diesel Fuel B | | |
|---|---|---|---|---|---|---|
| Additive | Auto CP | Herzog | CFPP | Auto CP | Herzog | CFPP |
| 6 | 3 | 2.4 | 4 | 8 | 6.3 | 7 |
| 7 | 1 | 2.2 | 4 | — | 7.2 | 4 |
| 8 | 2 | 2.5 | 4 | — | 5.4 | 0 |
| 9 | 3 | 2.5 | 4 | — | 6.5 | 4 |
| 10 | — | 1.2 | — | — | 7.4 | 7 |

As can be seen from the above test results, the products in accordance with the present invention exhibit comsiderable low temperature improving characteristics for distillate fuels.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A liquid hydrocarbyl fuel additive product of the reaction of (1) a diaminodiol or mixture of diaminodiols, and (2) a reactive acid/anhydride monomer or mixture of reactive acid/anhydride monomers derived from the reaction of benzophenone tetracarboxylic dianhydride with (a) an aminoalcohol, the product of an amine and an epoxide, or (b) the combination of said aminoalcohol and an amine prepared by the following stepwise procedure:

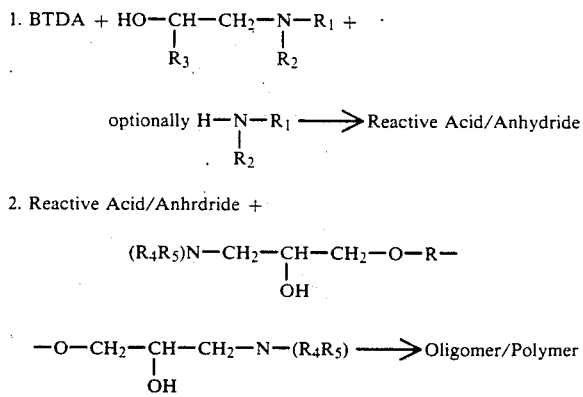

where $R_1$, $R_3$, $R_4 = C_8$ to about $C_{50}$ hydrocarbyl, $R_2 = R_1$, $C_1$ to about $C_{100}$ hydrocarbyl, or $C_1$ to about $C_{100}$ hydrocarbyl containing nitrogen, sulfur, phosphorus and/or oxygen, $R_5 = R_4$, $C_1$ to about $C_{100}$ hydrocarbyl, or $C_1$ to about $C_{100}$ hydrocarbyl containing nitrogen, sulfur, phosphorus and/or oxygen by reacting in molar ratios, less than molar ratios and more than molar ratios wherein the temperature may vary from about 100° C. to 250° C., the pressure may vary from 0.001 atm to 10 atm or slightly higher and the time may vary up to 48 hours or more.

2. The product of claim 1 wherein the diaminodiol is derived from the reaction of a diglycidyl ether and an amine.

3. The product of claim 2 wherein the amine is di(hydrogenated tallow) amine and the diglycidyl ether is 2,2-dimethyl-1-3-propanediol diglycidyl ether.

4. The product of claim 2 wherein the amine is di(hydrogenated tallow) amine and the diglycidyl ether is 1,4-butanediol diglycidyl ether.

5. The product of claim 2 wherein the amine is di(hydrogenated tallow) amine and the diglycidyl ether is a polyetherglycol diglycidyl ether.

6. The product of claim 1 wherein the reactive acid/anhydride is derived from benzophenone tetracarboxylic dianhydride, and co-reacted with phthalic anhydride.

7. The product of claim 6 wherein the amine is di(hydrogenated tallow) amine and the diglycidyl ether is 2,2-dimethyl-1-3-propanediol diglycidyl ether.

8. The product of claim 6 wherein the amine is di(hydrogenated tallow) amine and the diglycidyl ether is 1,4-butanediol diglycidyl ether.

9. The product of claim 6 wherein the amine is di(hydrogenated tallow) amine and the diglycidyl ether is a polyetherglycol diglycidyl ether.

10. The product of claim 1 wherein the diaminodiol is derived according to the following generalized scheme:

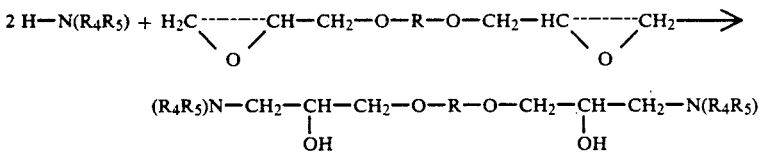

where $R = C_1$ to about $C_{100}$ hydrocarbyl, or $C_1$ to about $C_{100}$ hydrocarbyl containing nitrogen, sulfur, phosphorus, boron, silicon and/or oxygen, where $R_4 = C_8$ to about $C_{50}$ hydrocarbyl groups $R_5 = R_4$, $C_1$ to about $C_{100}$ hydrocarbyl, or $C_1$ to about $C_{100}$ hydrocarbyl containing nitrogen, sulfur, phosphorus, boron, silicon and/or oxygen.

11. The product of claim 1 wherein the oligomer/polymer derived from benzophenone tetracarboxylic dianhydride partial ester and diaminodiol has the following generalized structure:

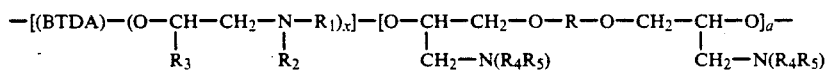

where:

$x = 0.5$ to about 3.5

$a = 0.25$ to about 2.

12. The product of claim 11 wherein the oligomer/polymer is derived from benzophenone tetracarboxylic dianhydride mixed partial ester derivatives having pendant amino alcohol groups which are different from one another.

13. The product of claim 1 wherein the oligomer/polymer derived from benzophenone tetracarboxylic dianhydride partial ester/amide and diaminodiol has the following general structure:

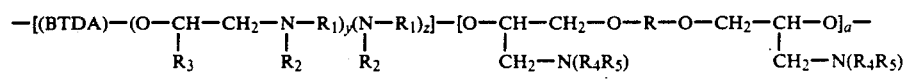

where:

$y + z = 0.5$ to about 3.5

$a = 0.25$ to about 2.

14. A composition suitable for preparing a liquid fuel comprising a liquid fuel concentrate solution consisting of a minor amount of an additive product in accordance with claim 1 dissolved in an inert solvent.

15. The composition of claim 14 wherein the solvent is xylene or mixed xylenes.

16. The composition of claim 14 comprising a total volume about 10 to 50 ml having dissolved therein from about 1 to 5 grams of said additive product.

17. A method of improving the low temperature characteristics of liquid hydrocarbyl distillate fuels comprising blending a minor amount of about 0.001% to about 10 wt % of an additive product as described in claim 1 with a major amount of said fuel.

18. An improved liquid hydrocarbyl fuel composition comprising a major amount of a combustible liquid hydrocarbon fuel and a minor low-temperature properties improving amount of 0.001% to about 10 wt % based on the total weight of the composition of an additive product of reaction prepared by reacting in molar ratios, less than molar ratios and more than molar ratios (1) a diaminodiol or mixture of diaminodiols and (2) a reactive acid anhydride or mixture of reactive acid/anhydride monomers derived from the reaction of benzophenone tetracarboxylic dianhydride or its acid equivalent with (a) an aminoalcohol, the product of an amine and an epoxide or (b) the combination of an aminoalcohol and an amine prepared by the following stepwise procedure:

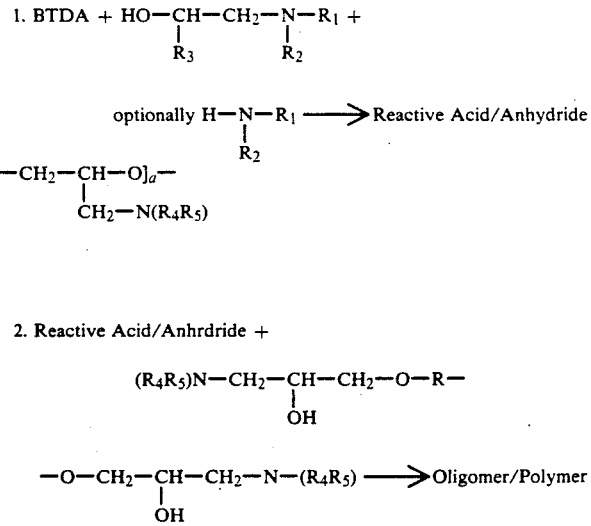

where $R_1$, $R_3$, $R_4 = C_8$ to about $C_{50}$ hydrocarbyl, $R_2 = R_1$, $C_1$ to about $C_{100}$ hydrocarbyl, or $C_1$ to about $C_{100}$ hydrocarbyl containing nitrogen, sulfur, phosphorus and/or oxygen, $R_5 = R_4$, $C_1$ to about $C_{100}$ hydrocarbyl, or $C_1$ to about $C_{100}$ hydrocarbyl containing nitrogen, sulfur, phosphorus and/or oxygen wherein the temperature may vary from about 100° C. to 250° C., the pressure may vary from 0.001 atm to 10 atm or slightly higher and the time may vary up to 48 hours or more.

19. The composition of claim 18 wherein the diaminodiol is derived from the reaction of a diglycidyl ether and an amine.

20. The composition of claim 19 wherein the amine is di(hydrogenated tallow) amine and the diglycidyl ether is 2,2-dimethyl-1-3-propanediol diglycidyl ether.

21. The composition of claim 19 wherein the amine is di(hydrogenated tallow) amine and the diglycidyl ether is 1,4-butanediol diglycidyl ether.

22. The composition of claim 19 wherein the amine is di(hydrogenated tallow) amine and the diglycidyl ether is a polyetherglycol diglycidyl ether.

23. The composition of claim 19 wherein the diaminodiol is derived according to the following general scheme:

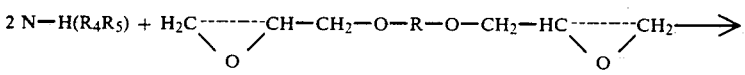

24. The composition of claim 18 wherein the reactive acid/anhydride is derived from benzophenone tetracarboxylic dianhydride and co-reacted with phthalic anhydride.

25. The composition of claim 24 wherein the amine is di(hydrogenated tallow) amine and the diglycidyl ether is 2,2-dimethyl-1-3-propanediol diglycidyl ether.

26. The composition of claim 24 wherein the amine is di(hydrogenated tallow) amine and the diglycidyl ether is 1,4-butanediol diglycidyl ether.

27. The composition of claim 24 wherein the amine is di(hydrogenated tallow) amine and the diglycidyl ether is a polyetherglycol diglycidyl ether.

28. The composition of claim 18 wherein the oligomer/polymer product derived from benzophenone tetracarboxylic dianhydride partial ester and diaminodiol has the following general structure:

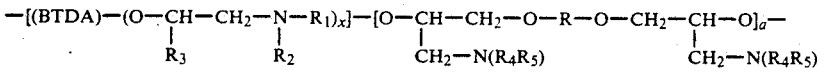

where x=0.5 to about 3.5, a=0.25 to about 2.

29. The composition of claim 18 wherein the oligomer/polymer product derived from benzophenone tetracarboxylic dianhydride mixed partial ester and diaminodiol having the pendant amino alcohol groups that are different from one another.

30. The composition of claim 18 wherein the oligomer/polymer derived from benzophenone tetracarboxylic dianhydride partial ester/amide has the following general structure:

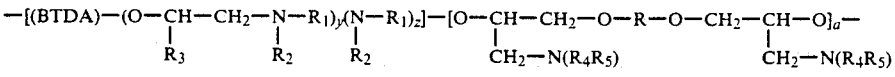

where:

y+z=0.5 to about 3.5 a=0.25 to about 2.

31. The composition of claim 18 where the liquid hydrocarbon combustible fuel is a distillate fuel.

32. The composition of claim 31 where the distillate fuel is selected from fuel oils.

33. The composition of claim 32 where the fuel oils are selected from heating fuel oil Nos. 1, 2 and 3 and diesel fuel oils.

34. The composition of claim 33 where the fuel oil is a heating fuel oil.

35. The composition of claim 34 where the fuel oil is a diesel fuel oil.

36. The composition of claim 18 where the minor amount comprises from about 0.01% to about 5 wt % based on the total weight of the composition.

37. A process for preparing a liquid hydrocarbyl fuel additive product of reaction suitable for use in fuel compositions by reacting in molar ratios, less than molar ratios and more than molar ratios comonomers comprising (1) a diaminodiol or mixture of diaminodiols and (2) a reactive acid/anhydride monomer product alone or in combination with other such monomers derived from the reaction of benzophenone tetracarboxylic dianhydride or its acid equivalent with (a) an aminodiol, the product of an amine and an epoxide, or (b) an aminoalcohol and an amine, or (c) mixtures of aminodiol and/or amine prepared by the following stepwise procedure:

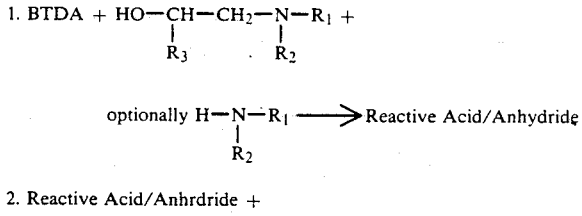

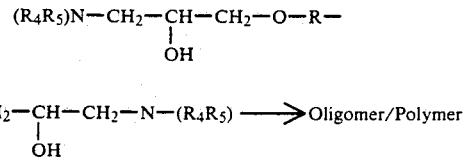

where $R_1$, $R_3$, $R_4$=$C_8$ to about $C_{50}$ hydrocarbyl, $R_2$=$R_1$, $C_1$ to about $C_{100}$ hydrocarbyl, or $C_1$ to about $C_{100}$ hydrocarbyl containing nitrogen, sulfur, phosphorus and/or oxygen, $R_5$=$R_4$, $C_1$ to about $C_{100}$ hydrocarbyl, or $C_1$ to about $C_{100}$ hydrocarbyl containing nitrogen, sulfur, phosphorus and/or oxygen wherein the temperature may vary from about 100° C. to 250° C., the pressure may vary from 0.001 atm to 10 atm or slightly higher and the time may vary up to 48 hours or more.

38. The process of claim 37 wherein the oligomers/-polymer derived from the benzophenone tetracarboxylic dianhydride partial ester and diaminodiol has the following generalized structure:

$$-[(BTDA)-(O-\underset{\underset{R_3}{|}}{CH}-CH_2-\underset{\underset{R_2}{|}}{N}-R_1)_x]-[O-\underset{\underset{CH_2-N(R_4R_5)}{|}}{CH}-CH_2-O-R-O-CH_2-\underset{\underset{CH_2-N(R_4R_5)}{|}}{CH}-O]_a-$$

$$-[(BTDA)-(O-\underset{\underset{R_3}{|}}{CH}-CH_2-\underset{\underset{R_2}{|}}{N}-R_1)_y(\underset{\underset{R_2}{|}}{N}-R_1)_z]-[O-\underset{\underset{CH_2-N(R_4R_5)}{|}}{CH}-CH_2-O-R-O-CH_2-\underset{\underset{CH_2-N(R_4R_5)}{|}}{CH}-O]_a-$$

where:

x=0.5 to about 3.5 a=0.25 to about 2.

39. The process of claim 37 wherein the oligomer/-polymer is derived from benzophenone tetracarboxylic dianhydride partial ester/amide has the following general structure:

* * * * *